US009968142B2

(12) United States Patent
Asodaria

(10) Patent No.: US 9,968,142 B2
(45) Date of Patent: May 15, 2018

(54) NURSING BRACELET

(71) Applicant: Rupal Asodaria, Fremont, CA (US)

(72) Inventor: Rupal Asodaria, Fremont, CA (US)

( * ) Notice: Subject to any disclaimer, the term of this patent is extended or adjusted under 35 U.S.C. 154(b) by 37 days.

(21) Appl. No.: 15/213,008

(22) Filed: Jul. 18, 2016

(65) Prior Publication Data

US 2017/0027242 A1 Feb. 2, 2017

Related U.S. Application Data

(60) Provisional application No. 62/197,177, filed on Jul. 27, 2015.

(51) Int. Cl.

| | |
|---|---|
| ***A41D 1/22*** | (2018.01) |
| ***A41D 1/20*** | (2006.01) |
| ***G09F 3/00*** | (2006.01) |
| *A41D 1/00* | (2018.01) |
| *A41F 19/00* | (2006.01) |
| *A44C 5/00* | (2006.01) |

(52) U.S. Cl.

CPC ..... *A41D 1/215* (2018.01); *A41D 1/205* (2013.01); *G09F 3/005* (2013.01); *A41F 19/00* (2013.01); *A44C 5/0015* (2013.01)

(58) Field of Classification Search

CPC ..... A41D 1/205; A41D 13/1236; A41D 13/1281; A41D 13/1245; A41D 1/22; A41D 2300/33; A41D 13/04; A41D 13/129; A41D 2300/32; A41D 2400/32; A41D 3/08; A41C 3/04; A41C 3/08; A41C 3/005; A61M 1/06; A61M 1/062; A61M 2209/088; A61M 2209/082; A44C 5/0015; A44C 5/0007; A44C 5/0023; A41B 13/10; A41B 1/06; A61B 5/002; A61B 5/0022; A61B 5/117; A61B 5/6804; A61B 5/681; A61B 90/90; A61B 90/94; A41F 15/02; A41F 19/00; A41F 9/025

See application file for complete search history.

(56) References Cited

U.S. PATENT DOCUMENTS 3,507,285 A * 4/1970 Williams ..... A41C 3/0064 450/1
4,004,294 A * 1/1977 Pinch ..... A41D 1/205 2/104
4,031,566 A * 6/1977 Johnson ..... A41D 1/205 2/104
4,144,593 A * 3/1979 Timmons ..... A41D 1/205 2/104
4,384,371 A * 5/1983 Sonne ..... A42B 1/206 2/104

(Continued)

*Primary Examiner* — Bobby Muromoto, Jr.
(74) *Attorney, Agent, or Firm* — GSS Law Group

(57) ABSTRACT

A nursing bracelet includes an adjustable elongate flexible band with a first fastener on a first side near a first end and a complementary second fastener on a second side opposite the first side at a second end. The nursing bracelet may be formed into a closed loop to hold a garment away from a woman's breast during breastfeeding or while using a breast pump to collect breast milk. The nursing bracelet may be worn on a wrist to remind a woman which breast was last used for breastfeeding a child or for collecting breastmilk, or alternately as a reminder about which breast is to be used for the next breastfeeding or breastmilk collection.

9 Claims, 4 Drawing Sheets

(56) References Cited

U.S. PATENT DOCUMENTS 4,528,699 A * 7/1985 Hughes ..... A41D 1/205 2/104
4,570,268 A * 2/1986 Freeman ..... A41D 13/1236 2/114
4,601,068 A * 7/1986 Frechette ..... A41D 1/205 2/104
4,633,876 A * 1/1987 Scullin ..... A41C 3/04 450/36
4,712,251 A * 12/1987 Cobble ..... A41D 1/205 2/104
4,797,953 A * 1/1989 Dameron ..... A41D 1/205 2/102
4,878,879 A * 11/1989 Kunstadter ..... A41C 3/04 2/101
4,911,677 A * 3/1990 White ..... A41C 3/04 2/104
4,924,528 A * 5/1990 Trombetti-Dickens ..... A41B 13/10 2/104
5,005,217 A * 4/1991 Bern ..... A41D 1/205 2/104
5,024,628 A * 6/1991 Sanchez ..... A41C 3/0028 2/104
5,090,059 A * 2/1992 Kahl ..... A41D 1/205 2/104
5,094,647 A * 3/1992 Courtney ..... A41C 3/04 2/104
5,259,068 A * 11/1993 Carroll ..... A41D 1/205 2/104
5,544,364 A * 8/1996 Weber ..... A41D 1/205 2/104
5,592,692 A * 1/1997 Larson ..... A41D 1/205 2/104
6,282,719 B1 * 9/2001 Vera ..... A41C 3/04 2/104
6,301,713 B1 * 10/2001 Aceves ..... A41D 1/205 2/104
6,327,712 B1 * 12/2001 Armstrong ..... A41D 1/205 2/104
6,361,398 B1 * 3/2002 Knapp ..... A41C 3/04 450/36
6,839,908 B2 * 1/2005 Schneider ..... A41D 1/205 2/104
7,077,720 B2 * 7/2006 Schneider ..... A41C 3/04 2/104
7,810,171 B2 * 10/2010 Moore ..... A41D 1/205 2/104
2003/0135909 A1 * 7/2003 LaTorre ..... A41D 1/205 2/104
2003/0191427 A1 * 10/2003 Jay ..... A61M 1/062 604/24
2004/0038621 A1 * 2/2004 Vera ..... A41D 1/205 450/36
2004/0080419 A1 * 4/2004 Martin ..... A61B 5/117 340/573.1
2004/0166766 A1 * 8/2004 Schneider ..... A41C 3/04 450/36
2005/0026540 A1 * 2/2005 Schneider ..... A41C 3/04 450/36
2005/0166636 A1 * 8/2005 Lazor ..... A44C 5/0007 63/38
2006/0011729 A1 * 1/2006 Sarela ..... A61B 5/681 235/472.01
2006/0101129 A1 * 5/2006 Rubertelli ..... G09F 3/005 709/217
2006/0118033 A1 * 6/2006 DelValle ..... A44C 5/0015 116/284
2006/0179542 A1 * 8/2006 Pierce ..... A44C 15/0025 2/170
2007/0010718 A1 * 1/2007 Spahn ..... A61B 90/90 600/300
2007/0249263 A1 * 10/2007 Itzhak ..... A41C 3/04 450/32
2007/0297293 A1 * 12/2007 DelValle ..... A44C 5/0015 368/223
2008/0000004 A1 * 1/2008 Lucock ..... A41D 1/205 2/104
2008/0016738 A1 * 1/2008 Talbott ..... A44C 5/0023 40/633
2008/0039781 A1 * 2/2008 Bjorge ..... A61M 1/062 604/74
2008/0064299 A1 * 3/2008 La Fontaine ..... A41C 3/04 450/36
2009/0000008 A1 * 1/2009 Moore ..... A41D 1/205 2/104
2009/0093189 A1 * 4/2009 Frey ..... A41C 3/00 450/1
2009/0205098 A1 * 8/2009 Araquistain ..... A41D 13/04 2/50
2012/0129428 A1 * 5/2012 Taylor ..... A41C 3/04 450/37
2012/0185993 A1 * 7/2012 Cohen ..... A41D 3/08 2/69
2012/0309264 A1 * 12/2012 Kubik ..... A41F 19/00 450/86
2013/0273809 A1 * 10/2013 Turk ..... A41C 3/0071 450/36
2014/0059732 A1 * 3/2014 Hennessey ..... A41B 13/10 2/49.1
2014/0068835 A1 * 3/2014 Toenjes ..... A41D 13/1236 2/114
2014/0364036 A1 * 12/2014 Abbaszadeh ..... A61M 1/062 450/36
2015/0067944 A1 * 3/2015 Olson ..... A41D 13/1281 2/114
2016/0015092 A1 * 1/2016 Abbaszadeh ..... A41C 3/04 450/36
2016/0073703 A1 * 3/2016 Shimada ..... A41D 1/205 2/104
2016/0183602 A1 * 6/2016 Rider ..... A61B 5/6804 450/36
2016/0219951 A1 * 8/2016 Schickel ..... A41D 13/1236
2016/0295932 A1 * 10/2016 Hayward ..... A41C 3/08
2017/0013886 A1 * 1/2017 Towfigh ..... A41C 1/10
2017/0273366 A1 * 9/2017 Hoth ..... A61M 1/062

* cited by examiner

NURSING BRACELET

CROSS REFERENCE

This application claims priority to U.S. Provisional Patent Application No. 62/197,177, titled "An adjustable slidable nursing reminder bracelet that secures a nursing mother's top during breastfeeding or pumping", filed Jul. 27, 2015, incorporated herein by reference in its entirety.

FIELD OF THE INVENTION

Embodiments are related to apparatus and methods for holding a woman's garment in a preferred position while breastfeeding a child or pumping breast milk.

BACKGROUND

A garment may have flaps or vents arranged for a woman to expose a breast for breastfeeding a child or for pumping breast milk. However, a woman may not own such a garment or may not be wearing such a garment when it is time to feed a child. A woman may instead prefer to pull a garment such as a sweater or blouse away from her breast while breastfeeding or while pumping breast milk. The neckline of a garment may be too small to pull down far enough to expose a breast. Or, after pulling the bottom hem of a garment upwards to expose a breast, the garment may fall downwards onto the child, possibly interfering with feeding the child, or may interfere with holding a breast pump against a breast.

A garment may be held away from a breast with one hand, by attaching a fastening device such as a pin or spring-loaded clip to the garment, or by tying the garment with a cord or lace. The hand used to hold the garment away from the child's face may not be available for other activities such as holding the child securely with both hands. While clips and pins have been used to hold a garment during nursing, a woman may not be comfortable using a pointed or hard object close to a child's face. Furthermore, previously known fastening devices for holding a garment may be difficult to operate with one hand, especially while holding a child in one's dominant hand. Moving a fastening device from one side to another on a garment, for example when moving a child or breast pump from one breast to the other, may be difficult to accomplish while holding the child.

SUMMARY

An example a method in accord with an embodiment includes inserting a first end of a nursing bracelet through a neck opening in a garment; passing a second end of the nursing bracelet around a bottom edge of the garment; and joining the second end of the nursing bracelet to the first end to form a closed loop, thereby drawing the bottom edge of the garment upwards toward the neck opening.

The example of a method may optionally include pulling the bottom edge of the garment toward the neck opening until a breast is exposed, then forming the closed loop with the nursing bracelet.

The example of a method may optionally include covering the exposed breast and uncovering the other breast without removing the nursing bracelet from the garment.

The example of a method may optionally include positioning and forming the closed loop with only one hand.

The example of a method may optionally include wearing the nursing bracelet on a wrist, and selecting the wrist to correspond to the breast last used for breastfeeding.

DESCRIPTION

Figure 1:
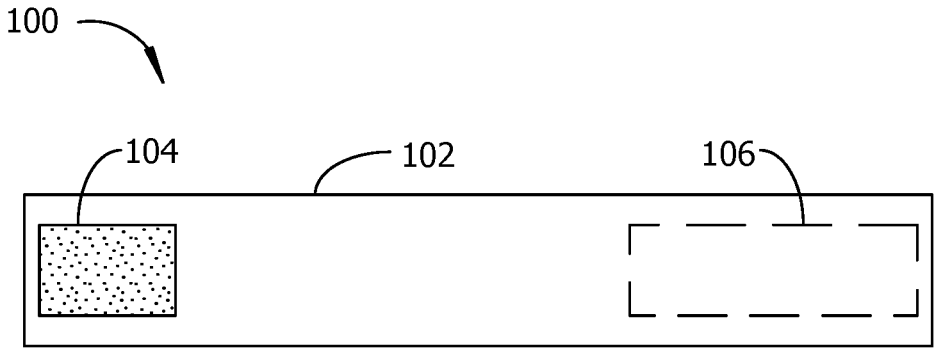
FIG. 1 shows a view toward a front side of an example of a nursing bracelet in accord with an embodiment.
Figure 2:
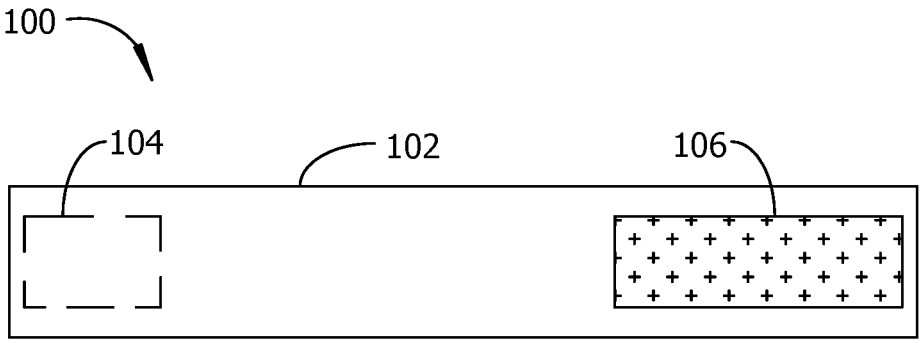
FIG. 2 shows a view toward a back side of the example of FIG. 1.
Figure 3:
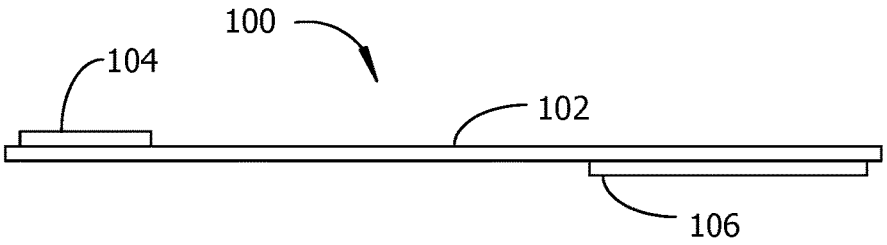
FIG. 3 shows a view toward a left side of the example of FIGS. 1-2.

An example of an apparatus in accord with an embodiment includes an elongate flexible strap arranged to form a closed loop by joining a fastener near a first end of the strap to a corresponding fastener near a second end of the strap. The apparatus embodiment, also referred to herein as a nursing bracelet, may be provided in a size for comfortably encircling a person's wrist and for holding the bottom hem of a garment above a woman's exposed breast while breastfeeding a child or while pumping breastmilk with a pumping appliance.

Embodiments may be placed for use on a garment by using only one hand, for example while holding a child with one hand and placing the embodiment with the other hand. After being placed on a woman's garment, embodiments free both of her hands for other activities, for example securely holding a child or positioning and operating a pumping device. The nursing bracelet may be worn on a wrist to remind a woman which breast last supplied milk, for example by wearing the bracelet on the left wrist as a reminder that the left breast was last used for feeding. Or, a woman may alternately choose to wear the nursing bracelet on the side to be used for the next feeding.

A nursing bracelet in accord with an embodiment is preferably made from soft, nontoxic, flexible materials selected to reduce the possibility of injury or discomfort to mother and child. This is in contrast to prior art solutions such as pins or clips, which may be difficult to position and operate one-handed and which may place a child in close proximity to pointed or hard parts.

A woman may forget which breast was last used to provide milk for a child. None of the previously available devices for holding a garment during breastfeeding assist a woman in remembering which breast last supplied the milk provided to a child. In contrast to previously known devices, embodiments may be positioned on a wrist or other convenient location to remind a woman which side was last used for feeding or pumping, or alternatively, which side should be used next. An embodiment may easily be repositioned from a left side of a garment to a right side without removing the embodiment from the garment. This contrasts with prior art solutions which must be detached from a garment to be moved to another location on the garment.

By leaving both hands free to cradle a child, embodiments may reduce muscular stress and/or pain in a mother's neck, back, and shoulders while feeding an infant. Using both hands to hold the child provides a more balanced feeding position than holding the child with only one hand, and provides a safer and more secure grip on the child.

Turning now to the figures, an example of a nursing bracelet in accord with an embodiment is shown FIGS. 1-4. The example of an adjustable nursing bracelet 100 in FIGS. 1 and 2 includes an elongate flexible strap 102 having a longest dimension sufficient to encircle a woman's wrist and to form a closed loop through the neck opening of a garment to suspend the bottom hem of the garment between a woman's neck and breast. The elongate flexible strap 102 has a first fastener 104 attached on a first side of the strap near a first end and a second fastener 106 is attached on a second side of the strap 102 near a second end. The second fastener 106 is positioned to engage with the first fastener 104. Examples of the first and second fasteners include, but are not limited to, complementary pieces of hook-and-loop fastener material, a rounded garment hook and an eyelet, a button and a button hole, and a snap. Complementary pieces (104, 106) of hook-and-loop material may also be referred to as thistle cloth. The first and second fasteners (104, 106) may be joined to the elongate strap 102 by strong attachment means such as stitching, fusing, riveting, swaging, or adhesive.

The first and second fasteners (104, 106) on the nursing bracelet 100 may be arranged to make the bracelet adjustable. An adjustable bracelet is capable of forming closed loops of different sizes to accommodate different sizes and styles of garments and different sizes of human wrists. As suggested in the examples of FIGS. 1-3, one part of the hook-and-loop fastener material may be made longer than the complementary part to provide for different attachment positions between the two parts, thereby altering the size of the closed loop formed by joining the ends of the strap 102 to one another. For example, a relatively small loop may be sufficient to hold a light garment such as a T-shirt in a preferred position away from an exposed breast, while a larger loop may be needed to hold a heavy sweater.

Figure 4:
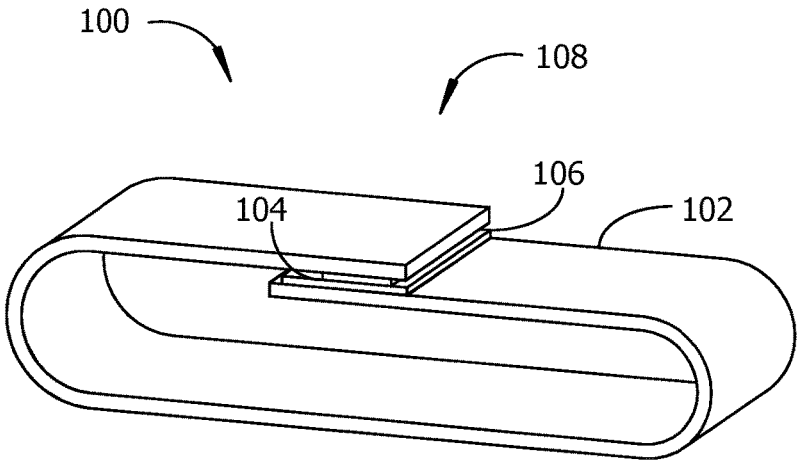
FIG. 4 shows a pictorial view of an example of a closed loop formed from the nursing bracelet of FIGS. 1-3.

FIG. 4 is a pictorial view of an example of a closed loop 108 formed by joining the complementary pieces of hook-and-loop material (104, 106) to one another. The closed loop may be formed quickly and easily by using only one hand to position and manipulate the strap and hook- and loop fastener. Opening a closed loop can also be performed quickly and easily with only one hand.

Figure 5:
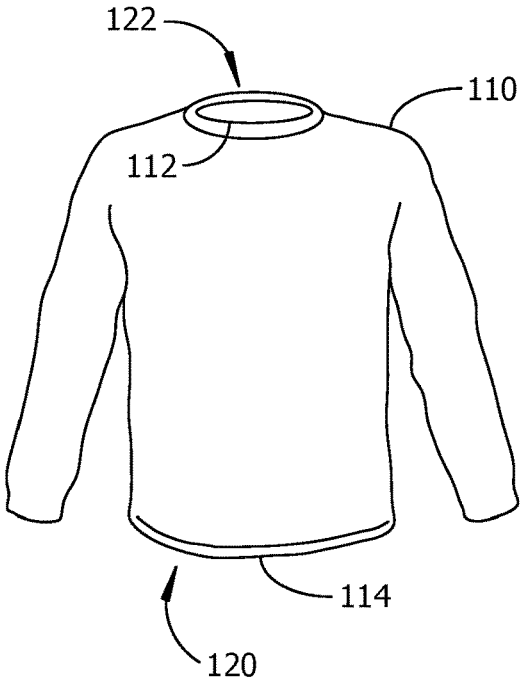
FIG. 5 shows an example of an upper-body garment such as a blouse or sweater.

FIG. 5 shows an example of a garment 110 which may be used with a nursing bracelet in accord with an embodiment. Examples of the garment 110 include, but are not limited to, a blouse, a sweater, a T-shirt, a robe, a sleeping gown, a pajama top, a camisole or other undergarment, outerwear such as a jacket or windbreaker, and so on. Although the illustrated garment example is a pullover, embodiments are effective for garments having zippers, buttons, or the like for opening part of the garment. Furthermore, embodiments are useful with garments having full-length sleeves as shown in examples in the figures, with short-sleeve garments, and with sleeveless garments. The example of a garment 110 in FIG. 5 includes a neck opening 112 and a bottom edge 114. The garment 110 may optionally include a collar near the neck opening 110. Embodiments are effective for use with short collars as suggested in the example of FIG. 5 and with other collar styles.

Figure 6:
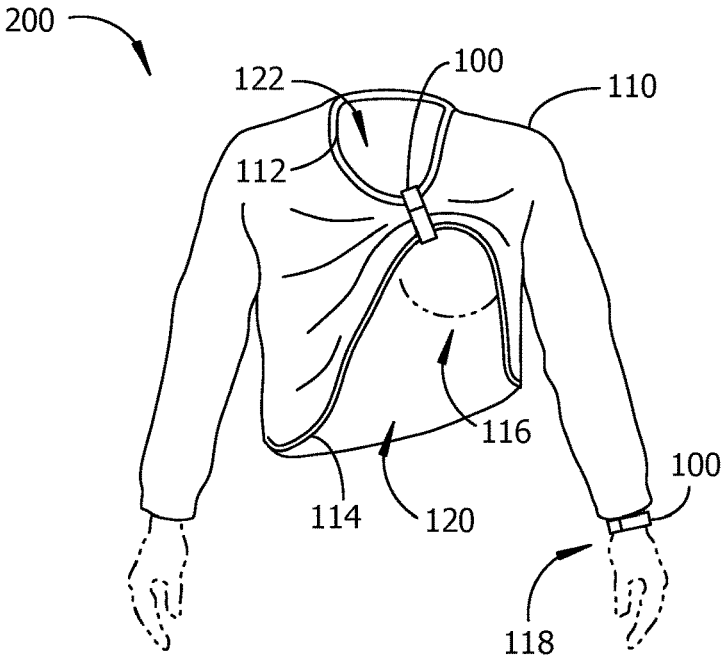
FIG. 6 shows a nursing bracelet formed into a closed loop and passing through the neck opening to hold the bottom hem above a woman's breast.

In the example of FIG. 6, a nursing bracelet 100 is formed into a closed loop and is passing through the neck opening 112 to hold the bottom hem 114 above a woman's breast 116. The nursing bracelet 100 may be positioned to expose either breast one at a time or both breasts at the same time. After the nursing bracelet has been positioned as suggested in the example of FIG. 6, the woman has both hands free to attend to other tasks and the breast will remain exposed until the bracelet is removed or repositioned. The closed loop formed in the nursing bracelet holds the garment away from a breast without using either a left hand or a right hand to hold the garment.

In the example of FIG. 6, the left breast has been exposed by the nursing bracelet. The right breast may be exposed without opening the closed loop of the nursing bracelet by grasping the bottom hem 114 near the nursing bracelet on the same side of the bracelet as the exposed breast and pulling gently downward on the hem to slide the hem through the closed loop. When the loop has not been made too tight, as the bottom hem pulls down on one side, it pulls up on the other, covering the previously exposed breast and uncovering the other.

Figure 7:
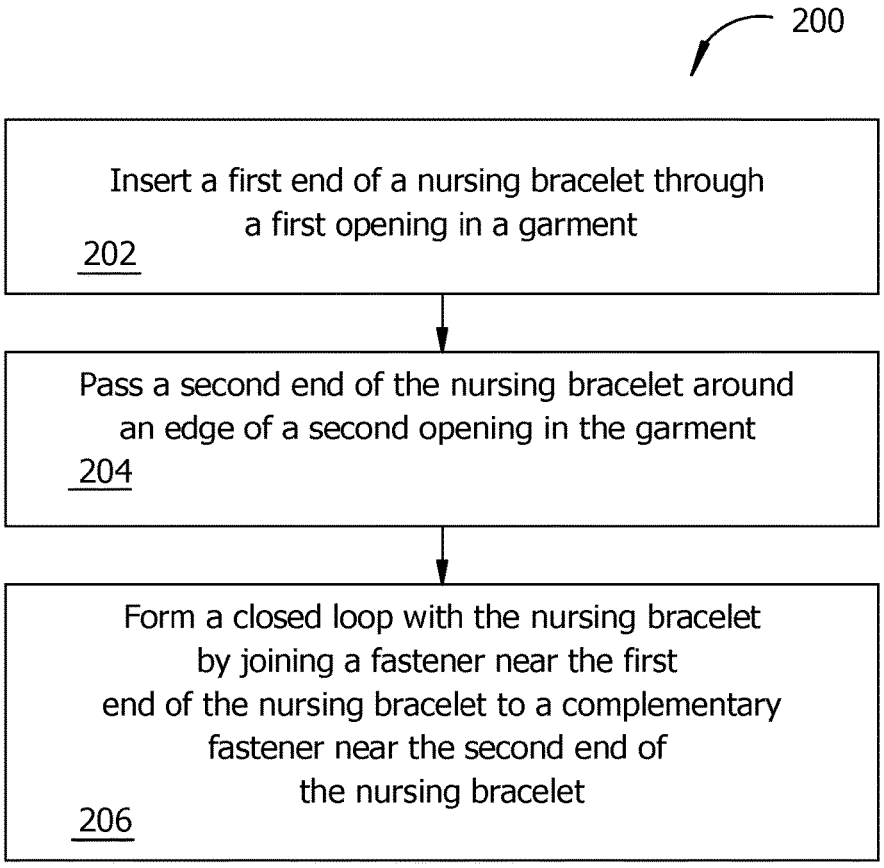
FIG. 7 illustrates an example of a method embodiment in which an example of a nursing bracelet holds the bottom hem of the garment above an exposed breast, and further illustrating an example of the nursing bracelet worn on a person's wrist.

FIG. 7 illustrates an example of a method embodiment 200. The example of a method embodiment 200 includes any one or more of the following steps, singly or in any combination:

inserting a first end of a nursing bracelet through a neck opening in a garment;

passing a second end of the nursing bracelet around a bottom edge of the garment;

joining the second end of the nursing bracelet to the first end to form a closed loop, thereby drawing the bottom edge of the garment upwards toward the neck opening;

pulling the bottom edge of the garment toward the neck opening until a breast is exposed, then forming the closed loop with the nursing bracelet;

covering the exposed breast and uncovering the other breast without removing the nursing bracelet from the garment;

positioning and forming the closed loop with only one hand;

detaching the nursing bracelet from the garment by opening the closed loop;

wearing the nursing bracelet on a wrist, and selecting the wrist to correspond to the breast last used for breastfeeding;

wearing the nursing bracelet on a wrist, and selecting the wrist to correspond to the breast to be used for the next breastfeeding; and preventing the garment from covering the exposed breast by holding the bottom edge of the garment between the exposed breast and the neck opening with the nursing bracelet.

It will be appreciated that some of the steps above can be performed in a different order. For example, the first end of the strap may first be inserted under the bottom hem of the garment, then upwards and out of the neck opening before forming the closed loop. Such variations are considered to be within the scope of the disclosed embodiments.

Unless expressly stated otherwise herein, ordinary terms have their corresponding ordinary meanings within the respective contexts of their presentations, and ordinary terms of art have their corresponding regular meanings.

What is claimed is:

1. A method, comprising:

inserting a first end of a strap for a nursing bracelet through a neck opening in a garment;

passing a second end of the strap around a bottom edge of the garment;

joining a fastener on a first side of the strap near the first end to a complementary fastener on a second side of the strap near the second end to form a closed loop, thereby drawing the bottom edge upwards toward the neck opening without the strap being attached to another garment and without providing the strap as part of the other garment.

2. The method of claim 1, further comprising pulling the bottom edge of the garment toward the neck opening until a breast is exposed, then forming the closed loop with the nursing bracelet.

3. The method of claim 2, further comprising covering the exposed breast and uncovering the other breast without removing the nursing bracelet from the garment.

4. The method of claim 1, further comprising positioning and forming the closed loop with only one hand.

5. The method of claim 1, further comprising detaching the nursing bracelet from the garment by detaching the fastener at the first end from the complementary fastener at the second end, thereby opening the closed loop, and removing the strap from the neck opening and bottom edge.

6. The method of claim 5, further comprising selecting a wrist to correspond to the breast last used for breastfeeding, placing the nursing bracelet on the selected wrist, and securing the nursing bracelet to the wrist by joining the fastener on the first side of the strap to the complementary fastener on the second side.

7. The method of claim 5, further comprising selecting a wrist to correspond to the breast to be used for the next breastfeeding, placing the nursing bracelet on the selected wrist, and securing the nursing bracelet to the wrist by joining the fastener on the first side of the strap to the complementary fastener on the second side.

8. The method of claim 1, further comprising preventing the garment from covering the exposed breast by holding the bottom edge of the garment between the exposed breast and the neck opening with the nursing bracelet.

9. The method of claim 1, wherein the closed loop holds the garment away from a breast without using either a left hand or a right hand to hold the garment.

* * * * *